US009157046B2

(12) United States Patent
Yagishita et al.

(10) Patent No.: US 9,157,046 B2
(45) Date of Patent: Oct. 13, 2015

(54) LUBRICATING OIL COMPOSITION

(75) Inventors: Kazuhiro Yagishita, Yokohama (JP); Tetsuo Okawa, Yokohama (JP)

(73) Assignee: NIPPON OIL CORPORATION, Tokyo (JP)

( * ) Notice: Subject to any disclaimer, the term of this patent is extended or adjusted under 35 U.S.C. 154(b) by 1650 days.

(21) Appl. No.: 11/751,180

(22) Filed: May 21, 2007

(65) Prior Publication Data

US 2007/0225181 A1 Sep. 27, 2007

Related U.S. Application Data

(63) Continuation of application No. PCT/JP2004/017818, filed on Nov. 24, 2004.

(51) Int. Cl.
*C10M 141/10* (2006.01)
*C10M 169/04* (2006.01)
*C10M 163/00* (2006.01)

(52) U.S. Cl.
CPC ..... *C10M 163/00* (2013.01); *C10M 141/10* (2013.01); *C10M 2203/1006* (2013.01); *C10M 2205/0285* (2013.01); *C10M 2207/024* (2013.01); *C10M 2207/026* (2013.01); *C10M 2207/028* (2013.01); *C10M 2207/262* (2013.01); *C10M 2209/084* (2013.01); *C10M 2215/064* (2013.01); *C10M 2215/28* (2013.01); *C10M 2219/046* (2013.01); *C10M 2223/04* (2013.01); *C10M 2223/041* (2013.01); *C10M 2223/042* (2013.01); *C10M 2223/043* (2013.01); *C10M 2223/045* (2013.01); *C10M 2223/047* (2013.01); *C10M 2223/049* (2013.01); *C10M 2223/061* (2013.01); *C10N 2210/02* (2013.01); *C10N 2230/02* (2013.01); *C10N 2230/06* (2013.01); *C10N 2230/08* (2013.01); *C10N 2230/10* (2013.01); *C10N 2230/42* (2013.01); *C10N 2230/43* (2013.01); *C10N 2230/52* (2013.01); *C10N 2230/72* (2013.01); *C10N 2260/14* (2013.01)

(58) Field of Classification Search
USPC ..... 508/363, 430, 435, 434, 443, 502, 192
See application file for complete search history.

(56) References Cited

U.S. PATENT DOCUMENTS

| | | | | | |
|---|---|---|---|---|---|
| 2,645,657 | A * | 7/1953 | Rudel et al. | 558/107 |
| 3,779,928 | A * | 12/1973 | Schlicht | 252/75 |
| 4,210,542 | A * | 7/1980 | Mann | 508/286 |
| 5,110,488 | A * | 5/1992 | Tipton et al. | 508/192 |
| 5,922,657 | A * | 7/1999 | Camenzind et al. | 508/430 |
| 6,638,897 | B2 * | 10/2003 | Ogano et al. | 508/192 |
| 2002/0142922 | A1 * | 10/2002 | Yagishita et al. | 508/374 |
| 2004/0072701 | A1 * | 4/2004 | Godici et al. | 508/282 |
| 2004/0127371 | A1 * | 7/2004 | Arrowsmith et al. | 508/518 |
| 2005/0143266 | A1 | 6/2005 | Yagishita | |

FOREIGN PATENT DOCUMENTS

| | | | |
|---|---|---|---|
| EP | 0098809 | A2 | 1/1984 |
| EP | 0 819 754 | A1 | 1/1998 |
| EP | 1 227 145 | A1 | 7/2002 |
| JP | 59-24792 | A | 2/1984 |
| JP | 10-67933 | A | 3/1998 |
| JP | 2002-265971 | A | 9/2002 |
| JP | 2002-294268 | A | 10/2002 |
| JP | 2002-294271 | A | 10/2002 |
| JP | 2002-338983 | A | 11/2002 |
| JP | 2004-83751 | A | 3/2004 |
| JP | 2005-002213 | A | 1/2005 |
| JP | 2005-002214 | A | 1/2005 |
| JP | 2005-002215 | A | 1/2005 |
| WO | 02/053687 | A2 | 7/2002 |
| WO | 02/079358 | A2 | 10/2002 |
| WO | 02/092735 | A1 | 11/2002 |
| WO | 02/102945 | A1 | 12/2002 |
| WO | 2004/020557 | A1 | 3/2004 |

* cited by examiner

*Primary Examiner* — James Goloboy
(74) *Attorney, Agent, or Firm* — Panitch Schwarze Belisario & Nadel LLP

(57) ABSTRACT

A lubricating oil composition is provided which is excellent in oxidation stability, base number retention properties, anti-wear properties, extreme pressure properties and anti-corrosion properties and is a low phosphorus and low sulfur lubricating oil composition particularly suitable for internal combustion engines. The composition comprises a lubricating base oil, (A) at least one type selected from the group consisting of metal salts of sulfur-free phosphorus-containing acidic organic compounds, (B) at least one type selected from the group consisting of phosphorus-containing carboxylic acid compounds and metal salts thereof, and (C) at least one type selected from the group consisting of anti-oxidants.

14 Claims, No Drawings

LUBRICATING OIL COMPOSITION

CROSS-REFERENCE TO RELATED APPLICATIONS

This application is a continuation of International Application No. PCT/JP2004/017818, filed Nov. 24, 2004, which was published in the Japanese language on Jun. 1, 2006, under International Publication No. WO 2006/057065 A1, the disclosure of which is incorporated herein by reference.

BACKGROUND OF THE INVENTION

The present invention relates to lubricating oil compositions. More specifically, the present invention relates to lubricating oil compositions which are extremely excellent in oxidation stability, base number retention properties, anti-wear properties, extreme pressure properties and anti-corrosion properties, particularly suitable for internal combustion engines.

Conventionally, lubricating oils have been used in internal combustion engines and automatic transmissions so as to facilitate the smooth operation thereof. In particular, lubricating oils for internal combustion engines (engine oils) have been required to possess high characteristic performances due to the fact that recent developed engines have been improved in performances, increased in power output and used under more severe operating conditions and further required to be improved in long-drain properties enabling the prolongation of oil drain intervals from the view point of recent environmental issues. Therefore, in order to fulfill such requirements, conventional engine oils are blended with various additives such as anti-wear agents, metallic detergents, ashless dispersants, and anti-oxidants so as to improve their characteristic performances.

The inventors of the present invention have already found that a lubricating oil composition containing less or no zinc dithiophosphate that is an anti-wear and anti-oxidation agent having been used conventionally as an indispensable additive for internal combustion engine lubricating oils, but containing a specific phosphorus-containing compound was able to exhibit extremely excellent long-drain properties (oxidation stability, base number retention properties and thermal stability) while maintaining anti-wear properties equally to a composition containing zinc dithiophosphate. As the result, the inventors filed patent application for such a lubricating oil composition, as disclosed in Japanese Patent Laid-Open Publication Nos. 2002-294271 and 2004-83751.

It was confirmed that a lubricating oil composition containing such a specific phosphorus compound when optically blended with other additives was able to exhibit anti-wear properties evaluated by a valve train wear test for domestically produced automobile engines as represented by JASO M328-95 comparably to a composition containing zinc dithiophosphate. However, the lubricating oil is required to possess extreme pressure properties and anti-wear properties more excellent than ever so as to be used in a special engine operating under more severe conditions or used under particular circumstances where more excellent extreme pressure properties and anti-wear properties are required; or required to fulfill a requirement that the phosphorus content is decreased to 0.08 percent by mass or less to meet the suitableness for an exhaust-gas purifying catalyst in the forthcoming ILSAC GF-4 standard or another requirement of low phosphorus content that the phosphorus content is decreased to 0.05 percent by mass or less to be sought in ILSAC GF-5 standard which is a plan under consideration. However, many of the sulfur-containing extreme pressure additives not only extremely degrade base number retention properties but also exert harmful influence on an exhaust-gas after-treatment device, i.e., fails to solve the problems that an exhaust-gas purifying catalyst such as a three-way catalyst, an oxidation catalyst and a NOx adsorber and DPF or an exhaust-gas treatment system which is the combination of DPF with the exhaust-gas purifying catalyst, in particular the oxidation catalyst or NOx adsorber undergo to catalyst poisoning and/or clogging of DPF caused by the increased sulfur. Therefore, it has been very difficult to produce a lubricating oil which can achieve the decrease of phosphorus and sulfur or additionally ash content while maintaining excellent long-drain properties, extreme pressure properties and anti-wear properties and reducing adverse affect on the exhaust-gas after-treatment device.

BRIEF SUMMARY OF THE INVENTION

In view of the foregoing circumstances, the present invention has an object to provide a lubricating oil composition which is further improved in extreme pressure properties and anti-wear properties with maintaining long-drain properties in a higher level, particularly suitable for an internal combustion engine.

As a result of an extensive study and research conducted by the inventors of the present invention to achieve the aforesaid object, the present invention was accomplished on the basis of the finding that a lubricating oil composition comprising a metal salt of a specific phosphorus-containing acidic organic compound blended with a specific phosphorus-containing carboxylic acid or a metal salt thereof and a specific anti-oxidant was able to be further improved in long-drain properties, extreme pressure properties and anti-wear properties.

That is, according to one aspect of the present invention, there is provided a lubricating oil composition comprising a lubricating base oil, (A) at least one type selected from the group consisting of metal salts of sulfur-free phosphorus-containing acidic organic compounds, (B) at least one type selected from the group consisting of phosphorus-containing carboxylic acid compounds and metal salts thereof, and (C) at least one type selected from the group consisting of anti-oxidants.

According to another aspect of the present invention, there is provided a low sulfur and low phosphorus engine system wherein an internal combustion engine using a fuel whose sulfur content is 50 ppm by mass or less is lubricated using a lubricating oil composition comprising a lubricating base oil, (A) at least one type selected from the group consisting of metal salts of sulfur-free phosphorus-containing acidic organic compounds, (B) at least one type selected from the group consisting of phosphorus-containing carboxylic acid compounds and metal salts thereof, and (C) at least one type selected from the group consisting of anti-oxidants and containing sulfur in an amount of 0.3 percent by mass or less and phosphorus in an amount of 0.08 percent by mass or less on the basis of the total amount of the composition.

The present invention will be described in more detail below.

DETAILED DESCRIPTION OF THE INVENTION

There is no particular restriction on the lubricating base oil of the lubricating oil composition of the present invention. Therefore, any conventional mineral and/or synthetic base oils to be used for lubricating oils may be used.

Examples of mineral oils which may be used in the present invention include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax) produced through a Fischer-Tropsch process.

There is no particular restriction on the % $C_A$ of the mineral base oil. However, the % $C_A$ is preferably 5 or less, more preferably 3 or less, and further more preferably 2 or less. The % $C_A$ may be 0 but is preferably 0.4 or greater and more preferably 1 or greater in view of the solubility of additives.

The term "% $C_A$" denotes a percentage of aromatic carbon number to total carbon number, determined by a method prescribed in ASTM D 3238-85.

There is no particular restriction on the sulfur content of the mineral oil. However, it is preferably 0.05 percent by mass or less, more preferably 0.01 percent by mass or less, and particularly preferably 0.001 percent by mass or less. A low sulfur lubricating oil composition with more excellent long-drain properties can be produced by decreasing the sulfur content of the mineral base oil.

Examples of synthetic lubricating base oils which may be used in the present invention include polybutenes and hydrogenated compounds thereof; poly-α-olefins such as 1-octene oligomer and 1-decene oligomer, and hydrogenated compounds thereof; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol-2-ethylhexanoate and pentaerythritol pelargonate; copolymers of dicarboxylic acids such as dibutyl maleate and α-olefins having 2 to 30 carbon atoms; aromatic synthetic oils such as alkylnaphthalenes, alkylbenzenes, and aromatic esters; and mixtures of the foregoing.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

There is no particular restriction on the kinematic viscosity of the lubricating base oil of the present invention. However, the kinematic viscosity at 100° C. is preferably 20 $mm^2/s$ or lower, more preferably 10 $mm^2/s$ or lower, and preferably 1 $mm^2/s$ or higher, more preferably 2 $mm^2/s$ or higher. A lubricating base oil with a kinematic viscosity at 100° C. exceeding 20 $mm^2/s$ is not preferable because the low temperature viscosity characteristics of the resulting lubricating oil composition would be degraded, while that with a kinematic viscosity at 100° C. of less than 1 $mm^2/s$ is not also preferable because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferable because the resulting lubricating oil composition would be large in evaporation loss of the base oil and the sulfur and phosphorus compounds or metals in the composition would accumulate on the exhaust gas purifying device together with the lubricating base oil, resulting not only in an increase in oil consumption but also in adverse affects on the exhaust gas purifying performance. The term "NOACK evaporation" used herein is defined as the amount of evaporation of the lubricating oil measured in accordance with ASTM D 5800.

There is no particular restriction on the viscosity index of the lubricating base oil. However, the viscosity index is preferably 80 or higher, more preferably 100 or higher, and further more preferably 120 or higher so as to be able to obtain excellent viscosity characteristics ranging from low temperatures to high temperatures. There is no particular restriction on the upper limit of the viscosity index. Therefore, the lubricating base oil may be those with a viscosity index of on the order of 135 to 180, such as n-paraffins, slack waxes and GTL waxes or isoparaffin-based mineral oils obtained by isomerization thereof and those with a viscosity index of on order of 150 to 250, such as complex ester-based or HVI-PAO-based base oils. A lubricating base oil with a viscosity index of less than 80 is not preferable because the low-temperature viscosity characteristics would be degraded.

Component (A) of the present invention is at least one type selected from the group consisting of metal salts of sulfur-free phosphorus-containing acidic organic compounds. Specific examples includes salts obtained by allowing a metal base such as a metal oxide, a metal hydroxide, a metal carbonate or a metal chloride to react with a phosphorus-containing acidic organic compound represented by formula (1) below, so as to neutralize the whole or a part of the remaining acid hydrogen:

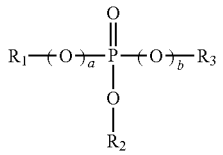

(1)

In formula (1), a and b are each independently 0 or 1, $R_1$, $R_2$, and $R_3$ are each independently hydrogen or a hydrocarbon having 1 to 30 carbon atoms, and at least one of them is hydrogen.

Specific examples of the hydrocarbon group having 1 to 30 carbon atoms include alkyl, cycloalkyl, alkenyl, alkyl-substituted cycloalkyl, aryl, alkyl-substituted aryl, and arylalkyl groups.

Examples of the alkyl group include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be straight-chain or branched.

Examples of the cycloalkyl group include those having 5 to 7 carbon atoms, such as cyclopentyl, cyclohexyl, and cycloheptyl groups. Examples of the alkylcycloalkyl group include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Example of the alkenyl groups include straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups, the position of which the double bonds may vary.

Examples of the aryl group include phenyl and naphtyl groups. Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphneyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, and phenylbutyl, phenylpentyl, and phenylhexyl groups, of which the alkyl groups may be straight-chain or branched.

The hydrocarbon group having 1 to 30 carbon atoms is preferably an alkyl or alkenyl group having 3 to 18 carbon atoms, more preferably an alkyl or alkenyl group having 4 to 12 carbon atoms, more preferably an alkyl groups having 3 to 8 carbon atoms, and particularly preferably an alkyl group having 4 to 6 carbon atoms because excellent extreme pressure properties and anti-wear properties can be attained.

Examples of the phosphorus-containing acidic organic compound of formula (1) include phosphoric acid monoesters and diesters having the above-described hydrocarbon group having 1 to 30 carbon atoms (where a and b are each one), alkyl or alkenyl phosphonic acids and alkyl or alkenyl phosphonic acid monoesters (where either a or b is 1 and the other is 0), dialkyl phosphonic acids (where both a and b are 0), and compounds wherein between the oxygen to which the hydrocarbon group having 1 to 30 carbon atoms and the phosphorus is inserted —$(OR_4)_n$— wherein $R_4$ is an alkylene group having 1 to 4 carbon atoms and n is an integer of 1 to 10.

Preferable examples of the phosphorus-containing acidic organic compound represented by formula (1) include phosphoric acid mono or di(n-butyl) ester, phosphoric acid mono or di(isobutyl) ester, phosphoric acid mono or di(n-pentyl) ester, phosphoric acid mono or di(n-hexyl) ester, phosphoric acid mono or di(1,3-dimethylbutyl) ester, phosphoric acid mono or di(4-methyl-2-pentyl) ester, phosphoric acid mono or di(n-heptyl) ester, phosphoric acid mono or di(n-octyl) ester, phosphoric acid mono or di(2-ethylhexyl) ester, phosphoric acid mono or di(isodecyl) ester, phosphoric acid mono or di(n-dodecyl) ester, phosphoric acid mono or di(isotridecyl) ester, phosphoric acid mono or di(oleyl) ester, phosphoric acid mono or di(stearyl) ester, phosphoric acid mono or di(n-octadecyl) ester; mono or di(n-butyl) phosphonic acid, mono or di(isobutyl) phosphonic acid, mono or di(n-pentyl) phosphonic acid, mono or di(n-hexyl) phosphonic acid, mono or di(1,3-dimethylbutyl) phosphonic acid, mono or di(4-methyl-2-pentyl) phosphonic acid, mono or di(n-heptyl) phosphonic acid, mono or di(n-octyl) phosphonic acid, mono or di(2-ethylhexyl) phosphonic acid, mono or di(isodecyl) phosphonic acid, mono or di(n-dodecyl) phosphonic acid, mono or di(diisotridecyl) phosphonic acid, mono or di(oleyl) phosphonic acid, mono or di(stearyl) phosphonic acid, mono or di(n-octadecyl) phosphonic acid; n-butyl phosphonic acid mono(n-butyl) ester, isobutyl phosphonic acid mono(isobutyl) ester, n-pentyl phosphonic acid mono(n-pentyl) ester, n-hexyl phosphonic acid mono(n-hexyl) ester, 1,3-dimethylbutyl phosphonic acid mono(1,3-dimethylbutyl) ester, 4-methyl-2-pentyl phosphonic acid mono(4-methyl-2-pentyl) ester, n-heptyl phosphonic acid mono(n-heptyl) ester, n-octyl phosphonic acid mono(n-octyl) ester, 2-ethylhexyl phosphonic acid mono(2-ethylhexyl) ester, isodecyl phosphonic acid mono(isodecyl) ester, n-dodecylphosphonic acid mono(n-dodecyl) ester, isotridecyl phosphonic acid mono(isotridecyl) ester, oleyl phosphonic acid mono(oleyl) ester, stearyl phosphonic acid mono(stearyl) ester, octadecyl phosphonic acid mono(octadecyl) ester. The hydrocarbon groups having 1 to 30 carbon atoms contained in the molecules of these phosphorus-containing acidic organic compounds can be arbitrarily selected. Therefore, the compounds may contain same or different hydrocarbon groups in their molecules, such as phosphoric acid butyl ester 2-ethylhexyl ester, phosphoric acid butyl ester oleyl ester, butyl phosphonic acid mono octyl ester, butyl phosphonic acid mono oleyl ester, 2-ethylhexyl phosphonic acid mono butyl ester, 2-ethylhexyl phosphonic acid mono oleyl ester, oleyl phosphonic acid mono methyl ester, oleyl phosphonic acid mono butyl ester, oleyl phosphonic acid mono octyl ester, oleyl phosphonic acid mono dodecyl ester, octadecyl phosphonic acid mono methyl ester, and octadecyl phosphonic acid mono ethyl ester.

Examples of the metal include alkali metals such as lithium, sodium, potassium, and cesium, alkaline earth metals such as calcium, magnesium, and barium, and heavy metals such as aluminum, zinc, copper, iron, lead, nickel, silver, manganese, and molybdenum, and mixture of the foregoing. Among these metals, preferred examples include alkali metals, alkaline earth metals, zinc, copper, aluminum, and molybdenum, and particularly preferred is zinc.

The above-described metal salts of the phosphorus-containing acidic organic compounds vary in structure depending on the valence of metals and the number of OH group of the phosphorus compounds. Therefore, there is no particular restriction on the structure of the metal salts. For example, when 1 mole of zinc oxide is reacted with 2 moles of phosphonic acid diester (one OH group), it is assumed that a compound with a structure represented by the formula below is obtained as the main component but polymerized molecules may also exist:

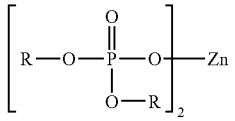

For another example, when 1 mole of zinc oxide is reacted with 1 mole of a phosphoric acid monoester (two OH groups), it is assumed that a compound with a structure represented by the formula below is obtained as the main component but polymerized molecules may also exist:

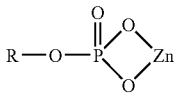

For metal salts of phosphonic acid, the foregoing is applied thereto. Examples of metal salts of phosphonic acid include those with a structure represented by the following formulas:

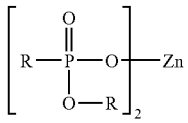

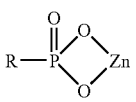

Since some compounds selected from Components (A) are insoluble or less soluble in a lubricating oil, it is particularly preferable in view of solubility of Component (A) and with the objective of shortening the production time of the lubricating oil composition that the compounds be presented as an oil-solved additive before it is blended to a lubricating base oil. There is no particular restriction on the method of rendering Component (A) oil soluble. Therefore, a method may be employed wherein Component (A) is mixed with and dissolved in or reacted with an amine compound, including an ashless dispersant such as succinimide and/or a derivative thereof, an aliphatic amine, an aromatic amine and a polyamine, or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and then subjected to vacuum-distillation to remove the solvent; methods similar thereto; or other known methods.

There is no particular restriction on the content of Component (A) in the lubricating oil composition of the present invention. However, the lower limit content is generally 0.001 percent by mass, preferably 0.01 percent by mass, and more preferably 0.02 percent by mass in terms of phosphorus based on the total mass of the composition. The upper limit is generally 0.2 percent by mass, preferably 0.1 percent by mass, more preferably 0.08 percent by mass, and particularly preferably 0.05 percent by mass in terms of phosphorus based on the total mass of the composition. Component (A) of the lower limit or more can provide the resulting lubricating oil composition with excellent extreme pressure properties and anti-wear properties, while Component (A) of the upper limit or less can achieve the decrease of phosphorus content of the lubricating oil composition. In particular when the lubricating oil composition of the present invention is used for an internal combustion engine, Component (A) of 0.08 percent by mass or less, particularly 0.05 percent by mass or less is contributive to the production of a low phosphorus type lubricating oil composition which is extremely less in adverse affects on the exhaust-gas purifying device.

Component (B) of the present invention is at least one type selected from the group consisting of phosphorus-containing carboxylic acid compounds and metal salts thereof. Specific examples of the phosphorus-containing carboxylic acid compounds include those represented by formula (2) below:

(2)

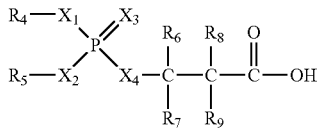

In formula (2), $X_1$, $X_2$, $X_3$, and $X_4$ are each independently oxygen or sulfur, $R_4$ and $R_5$ are each independently a hydrocarbon group having 1 to 30 carbon atoms, and $R_6$, $R_7$, $R_8$, and $R_9$ are each independently hydrogen or a hydrocarbon group having 1 to 4 carbon atoms.

In the compound represented by formula (2), preferably two of $X_1$, $X_2$, $X_3$, and $X_4$ are sulfur and the others are oxygen, and particularly preferably $X_1$ and $X_2$ are oxygen and $X_3$ and $X_4$ are sulfur.

Examples of the hydrocarbon group having 1 to 30 carbon atoms include alkyl, cycloalkyl, alkenyl, alkyl-substituted cycloalkyl, aryl, alkyl-substituted aryl, and arylalkyl groups. Specific examples include those exemplified with respect to $R_1$ to $R_3$ of Component (A).

With regard to $R^6$ to $R^9$, preferably at least two of them are hydrogen and particularly preferably all of them are hydrogen.

Examples of the metals salts of the phosphorus-containing carboxylic acid compounds include those obtained by allowing a metal base such as a metal oxide, a metal hydroxide, a metal carbonate or a metal chloride to react with a phosphorus-containing carboxylic acid compound so as to neutralize the whole or a part of the remaining acid hydrogen.

The metals may be those used for Component (A).

Component (B) is preferably a metal salt of the above-described phosphorus-containing carboxylic acid compound because of its excellent base number retention properties.

There is no particular restriction on the content of Component (B) in the lubricating oil composition of the present invention. However, the lower limit content is generally 0.001 percent by mass, preferably 0.005 percent by mass, and more preferably 0.01 percent by mass in terms of sulfur on the basis of the total mass of the composition. The upper limit content is preferably 0.05 percent by mass and more preferably 0.03 percent by mass in terms of sulfur on the basis of the total mass of the composition with the objective of not degrading the base number retention properties.

There is no particular restriction on the total content of Components (A) and (B). However, the total content is preferably 0.01 percent by mass or more, more preferably 0.02 percent by mass or more and preferably 0.2 percent by mass or less, more preferably 0.1 percent by mass or less, more preferably 0.08 percent by mass or less, more preferably 0.06 percent by mass or less, and particularly preferably 0.05 percent by mass or less in terms of phosphorus on the basis of the total mass of the composition.

There is no particular restriction on the mass ratio of Component (A) to Component (B) (the amount of Component (A) in terms of phosphorus/the amount of Component (B) in terms of sulfur). However, the mass ratio is preferably from 0.5 to 20, more preferably from 0.5 to 10, and particularly preferably from 1 to 4 with the objective of obtaining all extreme pressure properties, anti-wear properties and base number retention properties.

Component (C) of the present invention is at least one type selected form the group consisting of anti-oxidants. Specific examples include known anti-oxidants used for lubricating oils which may be chain termination type anti-oxidants such as phenolic anti-oxidants and aminic anti-oxidants; peroxide decomposer type anti-oxidants such as zinc dithiophosphate-, zinc dithiocarbamate-, molybdenum dithiophosphate- and molybdenum dithiocarbamate-based anti-oxidants; phosphorus-based anti-oxidants; sulfur-based anti-oxidants; and copper-based anti-oxidants.

Examples of the phenolic anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'- thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3 -(3 ,5-di-tert-butyl-4-hydroxyphenyl)propionate, pentaerythrityl-tetraquis[3-(3,5-di-tert-butyl-4- hydroxyphenyl)propionate], octyl-3-(3,5-di-tert-butyl-4-hydroxyphenyl) propionate, octadecyl-3-(3,5-di-tert-butyl-4-hydroxyphenyl)propionate and octyl-3-(3-methyl-5-tert-butyl-4-hydroxyphenyl) propionate. Mixtures of two or more of these compounds may be used.

Examples of the aminic anti-oxidants include phenyl-α-naphtylamines, alkylphenyl-α-naphtylamines, dialkyldiphenylamines, and phenothiazine. A mixture of two or more of these anti-oxidants may be blended.

Among the above anti-oxidants, the lubricating oil composition of the present invention should contain indispensably a chain termination type anti-oxidant such as a phenolic or aminic anti-oxidant.

The content of Component (C) in the lubricating oil composition of the present invention is preferably 5.0 percent by mass or less, more preferably 3.0 percent by mass or less, and more preferably 2.5 percent by mass or less on the basis of the total mass of the composition. Component (C) of more than 5.0 percent by mass fails to obtain sufficient base number retention properties as balanced with the content. The content of Component (C) is 0.1 percent by mass or more and more preferably 1.0 percent by mass or more based on the total mass of the composition with the objective of further, enhancing the base number retention properties.

The lubricating oil composition of the present invention preferably contains at least one type selected from the group consisting of (D) ashless dispersants and (E) metallic detergents.

Component (D), i.e., ashless dispersant may be any of those used in lubricating oils, such as nitrogen-containing compounds having at least one straight-chain or branched alkyl or alkenyl group having 40 to 400 carbon atoms per molecule and derivatives thereof, and modified products of alkenyl succinimides. A mixture of any one or more of these compounds may be blended with the composition.

The carbon number of the alkyl or alkenyl group is preferably 40 to 400 and preferably 60 to 350. An alkyl or alkenyl group having fewer than 40 carbon atoms is not preferable because it would degrade the solubility of the compound in a lubricating base oil, while an alkyl or alkenyl group having more than 400 carbon atoms is not also preferable because it would degrade the low-temperature fluidity of the resulting lubricating oil composition. The alkyl or alkenyl group may be straight-chain or branched but is preferably a branched alkyl or alkenyl group derived from an oligomer of an olefin such as propylene, 1 -butene, and isobutylene or from a cooligomer of ethylene and propylene.

Specific examples of Component (D) include the following compounds one or more of which may be used:

(D-1) succinimides having in their molecules at least one alkyl or alkenyl group having 40 to 400 carbon atoms and derivatives thereof;

(D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (3) and (4):

(3)

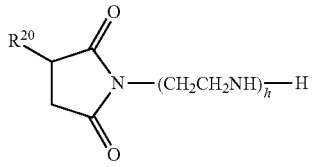

wherein $R^{20}$ is an alkyl or alkenyl group having 40 to 400 and preferably 60 to 350 carbon atoms, and h is an integer from 1 to 5, preferably 2 to 4; and (4)

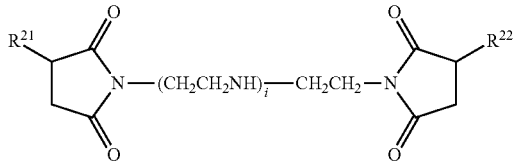

wherein $R^{21}$ and $R^{22}$ are each independently an alkyl or alkenyl group having 40 to 400, preferably 60 to 350 carbon atoms, and particularly preferably a polybutenyl group, and i is an integer from 0 to 4, preferably 1 to 3.

Succinimides include mono-type succinimides wherein a succinic anhydride is added to one end of a polyamine, as represented by formula (3) and bis-type succinimides wherein a succinic anhydride is added to both ends of a polyamine, as represented by formula (4). The lubricating oil composition of the present invention may contain either type of the succinimides or a mixture thereof.

There is no particular restriction on the method of producing these succinimides. For example, a method may be used wherein an alkyl or alkenyl succinimide obtained by reacting a compound having an alkyl or alkenyl group having 40 to 400 carbon atoms with maleic anhydride at a temperature of 100 to 200° C. is reacted with a polyamine. Specific examples of such a polyamine include diethylene triamine, triethylene tetramine, tetraethylene pentamine and pentaethylene hexamine.

Specific examples of (D-2) benzylamines include compounds represented by formula (5):

(5)

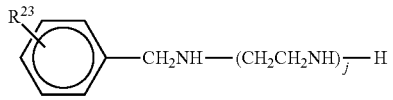

wherein $R^{23}$ is an alkyl or alkenyl group having 40 to 400 and preferably 60 to 350 carbon atoms, and j is an integer from 1 to 5, preferably 2 to 4.

There is no particular restriction on the method for producing the benzylamines. For example, the benzylamines may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D-3) polyamines include compounds represented by formula (6):

$$R^{24}—NH—(CH_2CH_2NH)_k—H \quad (6)$$

wherein $R^{24}$ is an alkyl or alkenyl group having 40 to 400 and preferably 60 to 350, and k is an integer from 1 to 5 and preferably 2 to 4.

There is no particular restriction on the method for producing the polyamines. For example, the polyamines may be produced by chlorinating a polyolefin such as a propylene oligomer, polybutene, or ethylene-α-olefin copolymer and then reacting the chlorinated polyolefin with ammonia or a polyamine such as ethylenediamine, diethylenetriamine, triethylenetetramine, tetraethylenepentamine, and pentaethylenehexamine.

Specific examples of the derivatives of the nitrogen-containing compounds exemplified as an example of Component (D) include an oxygen-containing organic compound-modified compound obtained by allowing any of the above-described nitrogen-containing compounds to react with a monocarboxylic acid having 1 to 30 carbon atoms, such as fatty acid, a polycarboxylic acid having 2 to 30 carbon atoms, such as oxalic acid, phthalic acid, trimellitic acid, and pyromellitic acid, and an anhydride or ester compound thereof, an alkyleneoxide having 2 to 6 carbon atoms, or a hydroxy(poly)oxyalkylenecarbonate so as to neutralize or amidize the whole or a part of the remaining amino and/or imino groups; a boron-modified compound obtained by allowing any of the above-described nitrogen-containing compounds to react with boric acid so as to neutralize or amidize the whole or a part of the remaining amino and/or imino groups; a phosphoric acid-modified compound obtained by allowing any of the above-described nitrogen-containing compounds to react with phosphoric acid so as to neutralize or amidize the whole or a part of the remaining amino and/or imino groups; a sulfur-modified compound obtained by allowing any of the above-described nitrogen-containing compounds to react with a sulfuric compound; and modified products obtained by a combination of two or more selected from the modifications with an oxygen-containing organic compound, boron, phosphoric acid and sulfur, of the above-described nitrogen-containing compounds. Among these derivatives, boric acid-modified compounds of alkenylsuccinimides are excellent in heat resistance and anti-oxidation properties and thus effective for further enhancing the base number retention properties of the lubricating oil composition of the present invention.

When the lubricating oil composition of the present invention contains Component (D), the content thereof is from 0.01 to 20 percent by mass and preferably 0.1 to 10 percent by mass based on the total mass of the composition. Component (D) of less than 0.01 percent by mass is less effective in high temperature detergency, while Component (D) of more than 20 percent by mass degrades extremely the low temperature fluidity of the resulting lubricating oil composition.

Eligible metallic detergents for Component (E) include known metallic detergents which have been used for a lubricating oil composition, such as alkali metal or alkaline earth metal sulfonates, alkali metal or alkaline earth metal phenates, alkali metal or alkaline earth metal salicylates, and mixtures thereof.

Specific examples of the alkali metal or alkaline earth metal sulfonates include alkali metal or alkaline earth metal salts, preferably magnesium and/or calcium salts, of alkyl aromatic sulfonic acids, obtained by sulfonating alkyl aromatic compounds having a molecular weight of 100 to 1,500 and preferably 200 to 700. Specific examples of alkyl aromatic sulfonic acids include petroleum sulfonic acids and synthetic sulfonic acids.

The petroleum sulfonic acids may be those obtained by sulfonating an alkyl aromatic compound contained in the lubricant fraction of a mineral oil or may be mahogany acid by-produced upon production of white oil. The synthetic sulfonic acids may be those obtained by sulfonating an alkyl benzene having a straight-chain or branched alkyl group, produced as a by-product from a plant for producing an alkyl benzene used as the raw materials of detergents or obtained by alkylating polyolefin to benzene, or those obtained by sulfonating an dinonylnaphthalene. There is no particular restriction on the sulfonating agent used for sulfonating these alkyl aromatic compounds. The sulfonating agent may be fuming sulfuric acids or sulfuric acid.

Specific examples of the alkali metal or alkaline earth metal phenates include alkali metal or alkaline earth metal salts, preferably magnesium salts and/or calcium salts, of alkylphenols having at least one straight-chain or branched alkyl group having 4 to 30, preferably 6 to 18 carbon atoms, alkylphenolsulfides obtained by reacting such alkylphenols with sulfur, or Mannich reaction products of the alkylphenols obtained by reacting alkylphenols with formaldehyde.

Specific examples of the alkali metal or alkaline earth metal salicylates include alkali metal or alkaline earth metal salts, preferably magnesium salts and/or calcium salts, particularly preferably a calcium salts of alkyl salicylic acids having at least one straight-chain or branched alkyl group having 1 to 30, preferably 10 to 26 carbon atoms, such as those obtained by carboxylating phenol or cresol or alkylating an olefin having 10 to 26 carbon atoms.

The alkali metal or alkaline earth metal sulfonates, alkali metal or alkaline earth metal phenates, and alkali metal or alkaline earth metal salicylates include neutral salts(normal salts) obtained by reacting alkyl aromatic sulfonic acids, alkylphenols, alkylphenolsulfides, alkylsalicylic acids, or Mannich reaction products of alkylphenols directly with a metal base such as an alkali metal or alkaline earth metal oxide or hydroxide or obtained by converting alkyl aromatic sulfonic acids, alkylphenols, alkylphenolsulfides, alkylsalicylic acids, or Mannich reaction products of alkylphenols to alkali metal salts such as sodium salts and potassium salts, followed by substitution with an alkaline earth metal salt; basic salts obtained by heating these neutral salts with an excess amount of an alkali metal or alkaline earth metal salt or an alkali metal or alkaline earth metal base (alkali metal or alkaline earth metal hydroxide or oxide) in the presence of water; and overbased salts (superbasic salts) obtained by reacting these neutral salts with a base such as an alkali metal or alkaline earth metal hydroxide in the presence of carbonic acid gas and/or boric acid or borate.

These reactions are generally carried out in a solvent (aliphatic hydrocarbon solvents such as hexane, aromatic hydrocarbon solvents such as xylene, and light lubricating base oil). Although metallic detergents are usually commercially available as diluted with a light lubricating base oil, it is preferred to use metallic detergents whose metal content is within the range of 1.0 to 20 percent by mass and preferably 2.0 to 16 percent by mass.

In the present invention, the base number of Component (E) is preferably 0 to 500 mgKOH/g and more preferably 20 to 450 mgKOH/g. Component (E) may be one or more of alkali metal or alkaline earth metal sulfonates, phenates, and salicylates. It is particularly preferred to use any of the salicylates as an essential component because of their extremely excellent long-drain properties. The term "base number" used herein denotes a base number measured by the perchloric acid potentiometric titration method in accordance with section 7 of JIS K2501 "Petroleum products and lubricants-Determination of neutralization number".

There is no particular restriction on the metal ratio of Component (E). Component (E) with a metal ratio of generally 20 or less and preferably from 1 to 15 is used. In the present invention, it is preferred to blend a metallic detergent with a metal ratio of 3 or less with in view of base number retention properties. It is also preferred to use a metallic detergent with a metal ratio of greater than 3 and preferably greater than 5 with the objective of further enhancing anti-wear properties. Therefore, desired base number retention properties and anti-wear properties are obtainable using these metallic detergents whose type and metal ratio are suitably selected, alone or in combination. The term "metal ratio" used herein is represented by "valence of metal element x metal element content (mol %)/soap group content (mol %) in a metallic detergent" wherein the metal element is calcium, magnesium, or the like and the soap group is a sulfonic acid group, a salicylic acid group, or the like.

There is no particular restriction on the amount of Component (E) to be blended. However, the upper limit is generally 1 percent by mass, preferably 0.5 percent by mass, and more preferably 0.2 percent by mass in terms of metal based on the total mass of the composition. The amount may be suitably selected depending the requisite sulfated ash content of the composition. The lower limit is generally 0.01 percent by mass, preferably 0.02 percent by mass, and particularly preferably 0.05 percent by mass. Component (E) of 0.01 percent by mass or more can enhance high temperature detergency and long-drain properties such as oxidation stability and base number retention properties.

In order to further enhance the performance characteristics of the lubricating oil composition of the present invention, it may be blended with any of additives which have been used in lubricating oils, depending on its purposes. Examples of such additives include anti-wear agents other than Component (A), friction modifiers, viscosity index improvers, corrosion inhibitors, rust inhibitors, demulsifiers, metal deactivators, anti-foaming agents, and dyes.

Examples of anti-wear agents other than Component (A) include phosphorus acid esters, phosphoric acid esters, and sulfur-containing compounds such as thiophosphorus acid esters, thiophosphoric acid esters, amine salts of these esters, metal salts of thiophosphoric acid esters (zinc dithiophosphate or the like), disulfides, olefin sulfides, sulfurized fats and oils and zinc dithiocarbamate. However, the lubricating oil composition of the present invention should be limited in the content of the sulfur-containing compounds, and particularly preferably contains no zinc dithiophosphate.

Examples of friction modifiers include molybdenum dithiocarbamate, molybdenum dithiophosphate, molybdenum-amine complexes, molybdenum-succinimide complexes, molybdenum disulfide; fatty acids, aliphatic alcohols, fatty acid esters, aliphatic ethers, fatty acid amides, and aliphatic amines each having an alkyl or alkenyl group having 6 to 30 carbon atoms; and mixtures thereof. These additives are useful because they can provide the composition with low-friction properties.

Examples of viscosity index improvers include non-dispersion type viscosity index improvers such as polymers or copolymers of one or more monomers selected from various methacrylic acid esters or hydrogenated compounds thereof; dispersion type viscosity index improvers such as copolymers of various methacrylic acid esters further containing nitrogen compounds; non-dispersion- or dispersion-type ethylene-α-olefin copolymers of which the α-olefin may be propylene, 1-butene, or 1-pentene, or a hydrogenated compound thereof; polyisobutylenes or hydrogenated compounds thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrogenated compounds thereof is from 800 to 500,000 and preferably from 3,000 to 200,000.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of the viscosity index improver is selected from 0.1 to 20 percent by mass on the basis of the total mass of the composition, the content of each of the anti-wear agent other than Component (A), friction modifier, corrosion inhibitor, rust inhibitor, and demulsifier is selected from 0.005 to 5 percent by mass on the basis of the total mass of the composition, the content of the metal deactivators is selected from 0.005 to 1 percent by mass on the basis of the total mass of the composition, and the content of the anti-foaming agent is selected from 0.0005 to 1 percent by mass on the basis of the total mass of the composition. In the present invention, the sulfur content of the sulfur-containing compounds among these additives other than Component (B) should be limited and is decreased to 0.2 percent by mass or less, more preferably 0.1 percent by mass or less, and particularly preferably 0.05 percent by mass on the basis of the total mass of the composition. Alternatively, the use of no sulfur-containing compound makes it possible to produce a low sulfur lubricating oil composition with further enhanced base number retention properties.

The lubricating oil composition of the present invention can be synergistically improved in extreme pressure properties and anti-wear properties due to the use of Components (A), (B) and (C) in combination and can exhibit base number retention properties equivalent to or better than those achieved when Components (A) and (C) are used in combination without Component (B). Therefore, the lubricating oil composition is useful as a low phosphorus type lubricating oil composition whose phosphorus content is 0.08 percent by mass or less, as stipulated by the ILSAC GF-4 gasoline engine oil standard, as well as a low phosphorus and low sulfur lubricating oil composition whose phosphorus content is further decreased to 0.05 percent by mass or less and whose sulfur content is decreased to 0.3 percent by mass or less, preferably 0.2 percent by mass or less, more preferably 0.1 percent by mass or less, further more preferably 0.05 percent by mass or less, and particularly preferably 0.01 percent by mass or less.

The lubricating oil composition of the present invention is excellent not only in long drain properties (oxidation stability and base number retention properties) and anti-wear properties but also in friction reducing effect and high temperature detergency and thus is preferably used as a lubricating oil for internal combustion engines such as gasoline engines, diesel engines and gas engines of motorcycles, automobiles, power generators, and ships. Furthermore, the lubricating oil composition of the present invention is a low sulfur and low phosphorus lubricating oil which is, therefore, suitable for an internal combustion engine equipped with an exhaust-gas after-treatment device such as an exhaust-gas purifying catalyst selected from an oxidation catalyst, a NOx adsorber, and a three-way catalyst and/or a diesel particulate filter (DPF), particularly an internal combustion engine equipped with an exhaust-gas after-treatment device which is the combination of an oxidation catalyst or a NOx adsorber with DPF. The lubricating oil composition of the present invention is particularly preferably used as a lubricating oil for an internal combustion engine, in particularly a gasoline or gas engine, using a low sulfur fuel whose sulfur content is 50 ppm by mass or less, preferably 30 ppm by mass or less, and particularly preferably 10 ppm by mass or less, such as gasoline, gas oil, or kerosene; a fuel whose sulfur content is 1 ppm by mass, such as LPG and natural gas; or a substantially sulfur-free fuel such as hydrogen, dimethylether, alcohols, and GTL (Gas to Liquid) fuel.

Moreover, the lubricating oil composition of the present invention is suitably used as a lubricating oil required to possess any of the above-described extreme pressure properties, anti-wear properties, base number retention properties, and oxidation stability, such as those for driving systems of automatic or manual transmissions, gear oils, greases, wet brake oils, hydraulic oils, turbine oils, compressor oils, bearing oils, refrigerating oils, or the like.

The low sulfur and phosphorus engine system of the present invention uses a lubricating oil composition comprising a base oil, Components (A), (B) and (C) and containing 0.3 percent by mass or less of sulfur and 0.08 percent by mass or less of phosphorus, and uses a fuel containing 50 ppm by mass or less of sulfur, thereby improving long-drain properties and anti-wear properties for valve systems and reducing adverse affects on an exhaust-gas after-treatment device such as a oxidation catalyst, a three-way catalyst, a NOx adsorber, and DPF.

Hereinafter, the present invention will be described in more details by way of the following examples and comparative examples, which should not be construed as limiting the scope of the invention.

EXAMPLES 1 to 3, AND COMPARATIVE EXAMPLES 1 TO 3

Lubricating oil compositions of the present invention (Examples 1 to 3) and those for comparison (Comparative Examples 1 to 3) were prepared as set forth in Table 1 below. The following performance evaluation tests (1) to (3) were carried out for each of the resulting compositions. The results are set forth in Table 1.

(1) High-speed Four-Ball Test

Each of the compositions was subjected to a high-speed four-ball test in accordance with ASTM D2783-88 at room temperature and a revolution of 1,800 rpm while the load on four balls is incrementally increased. The load (LNSL, last non-seizure load) at which wear occurred on the balls was measured. A higher LNSL value indicates that the composition is excellent in anti-wear properties and extreme pressure properties.

(2) Falex Test

The seizure load (lbs) was measured by Falex test (procedure B) in accordance with ASTM D 3233 under conditions where after a 5-min run-in operation was carried out at a revolution of 290 rpm, an oil temperature of 80° C. and a load of 250 lbs for 5 minutes, the load was incrementally increased. A higher seizure load indicates that the composition is more excellent in extreme pressure properties.

(3) Changes in Base Number with Time Measured by a NOx Adsorbing Test (Total Base Number Remaining Rate)

A NOx adsorbing test was carried out under condition described in "Proceedings of JAST (Japanese Society of Tribologists) Tribology Conference 1992, 10, 465". Each of the sample oils kept at 140° C. was forced to degrade by blowing thereto an air-fuel mixture whose NOx gas concentration was 1198 ppm so as to measure the change in base number (HCl method) with time. A higher base number remaining rate against the testing time indicates that the sample oil excels in base number retention properties.

It is apparent from the results set forth in Table 1 that the composition comprising Components (A) to (C) in combination and containing 0.03 percent by mass of sulfur (the content of Component (B) was 0.02 percent by mass in terms of sulfur) and 0.05 percent by mass of phosphorus (Examples 1 to 3) were higher in LNSL in the high-speed four-ball test, seizure load in the Falex test, and base number remaining rate than the compositions containing no Component (B) with the phosphorus content of 0.05 percent by mass. It is also apparent that the composition containing zinc dithiophosphate instead of Components (A) and (B), with the phosphorus content of 0.05 percent by mass (Comparative Example 3) was poor not only in LNSL in the high-speed four-ball test and seizure load in the Falex test but also in base number remaining rate. It was also confirmed that a composition containing no Component (A) but Component (B) in an amount of 0.05 percent by mass in terms of phosphorus was extremely poor in base number retention properties.

EXAMPLE 4 AND COMPARATIVE EXAMPLE 4

A lubricating oil composition of the present invention (Example 4) and that for comparison (Comparative Example 4) were prepared as set forth in Table 2 below. The following performance evaluation test (4) was carried out for each of the resulting compositions. The results are set forth in Table 2.

(4) Valve Train Wear Test

A valve train wear test was conducted in compliance with JASO M 328-95 so as to measure the rocker arm pad scuffing area, the rocker arm wear and the cam nose wear after 100 hours test. The value of 10 or less indicates that the composition extremely excels in anti-wear properties.

The fuel used in this test was a sulfur-free gasoline containing 10 ppm by mass or less of sulfur.

As apparent from the results set forth in Table 2, the composition of Comparative Example 4 was a low phosphorus and low sulfur type lubricating oil composition, the phosphorus and sulfur contents of which composition were 0.07 percent by mass and 0.01 percent by mass, respectively and excelled in anti-wear properties for valve trains and base number retention properties though containing no Component (B).

Whereas, the composition of Example 4 according to the present invention was a low phosphorus and low sulfur type lubricating oil composition, the phosphorus and sulfur contents of which composition were 0.07 percent by mass and 0.01 percent by mass, respectively that are the same as those of Comparative Example 4 and exhibited excellent anti-wear properties for valve trains and in particular the cam nose wear that is on the order of one-tenth of that in the composition of Comparative Example 4.

In an engine test using the foregoing sulfur-free gasoline containing 10 ppm by mass or less of sulfur, it was confirmed that the composition of Example 4 exhibited practical performances such as base number retention properties, total acid number increase rate, viscosity increase rate and detergency for engines that were equivalent to or better than those of the composition of Comparative Example 4.

TABLE 1

| | | Example 1 | Example 2 | Example 3 | Comparative Example 1 | Comparative Example 2 | Comparative Example 3 |
|---|---|---|---|---|---|---|---|
| Lubricating base oil[1)] | mass % | balance | balance | balance | balance | balance | balance |
| (A) Sulfur-free phosphorus-containing organic acidic metal salt A[2)] | mass % | 0.30 | — | 0.30 | 0.40 | — | — |
| (A) Sulfur-free phosphorus-containing organic acidic metal salt B[3)] | mass % | — | 0.43 | — | — | 0.54 | — |
| Sulfur-containing organic acid metal salt[4)] | mass % | — | — | — | — | — | 0.55 |
| (B) Phosuphorus-containing carboxylic acid compound[5)] | mass % | 0.10 | 0.10 | — | — | — | — |
| (B) Metal salt of phosuphorus-containing carboxylic acid compound[6)] | mass % | — | — | 0.10 | — | — | — |
| (C) Anti-oxidant[7)] | mass % | 1.50 | 1.50 | 1.50 | 1.50 | 1.50 | 1.50 |
| Ashless dispersant[8)] | mass % | 4.50 | 4.50 | 4.50 | 4.50 | 4.50 | 4.50 |
| Metallic detergent[9)] | mass % | 2.15 | 2.15 | 2.15 | 2.15 | 2.15 | 2.15 |
| Other additives[10)] | mass % | 4.00 | 4.00 | 4.00 | 4.00 | 4.00 | 4.00 |
| Element concentration | | | | | | | |
| Ca | mass % | 0.130 | 0.130 | 0.136 | 0.130 | 0.130 | 0.130 |
| P | mass % | 0.050 | 0.050 | 0.050 | 0.050 | 0.050 | 0.050 |
| Zn | mass % | 0.050 | 0.050 | 0.050 | 0.050 | 0.050 | 0.050 |
| S | mass % | 0.030 | 0.030 | 0.030 | 0.010 | 0.010 | 0.110 |
| N | mass % | 0.130 | 0.130 | 0.130 | 0.130 | 0.130 | 0.130 |
| High-speed four-ball test WL | N | 1961 | 1961 | 1961 | 1961 | 1961 | 1961 |
| LNSL | N | 981 | 981 | 981 | 785 | 785 | 785 |
| Falex test, Seizure load | lbs | 530 | 530 | 510 | 430 | 430 | 430 |
| NOx bubbling test | | | | | | | |
| Base number (HCl method) retention at 30 hours | % | 30 | 32 | 32 | 28 | 27 | 19 |
| Base number (HCl method) retention at 65 hours | % | 18 | 20 | 20 | 17 | 17 | 0 |

[1)]Hydrotreated mineral oil, kinematic viscosity @ 100° C.: 4.7 $mm^2/s$, viscosity index: 120, sulfur content: 10 mass ppm, % CA: 0.6

[2)]Zinc dibutylphosphate represented below, phosphorus content: 12.8 mass %, zinc content: 12.8 mass %, R: butyl

[3)]Zinc salt of alkylphosphonic acid ester represented below, phosphorus content: 9.2 mass %, zinc content: 9.2 mass %, R: 2-ethylhexyl

[4)]Zinc dialkyldithiophosphate, phosphorus content: 7.2 mass %, alkyl group: sec-butyl or 4-methyl2-pentyl

[5)]β-dithiophosphorylated propionic acid represented below, phosphorus content: 9.9 mass %, R: isobutyl

[6)]Calcium salt of β-dithiophosphorylated propioic acid, phosphorus content: 9.3 mass %, calcium content: 6 mass %, R: isobutyl

[7)]4,4'-methylene-bis-2,6-di-tert-butylphenol and dialkyldiphenylamine

[8)]Borated polybutenyl succinicimide, nitrogen content: 1.5 mass %, boron content: 0.5 mass %, weight-average molecular weight: 3000

[9)]Ca salicylate, total base number: 170 mgKOH/g, calcium content: 6 mass %

[10)]Additives containing viscosity index improver (PMA, OCP), anti-foaming agent 2)
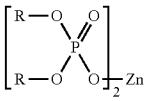

3)
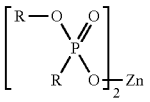

5)
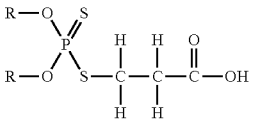

6)
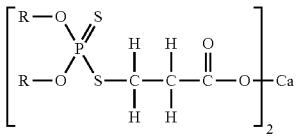

TABLE 2

| | | Example 4 | Comparative Example 4 |
|---|---|---|---|
| Lubricating base oil[1)] | mass % | balance | balance |
| (A) Sulfur-free phosphorus-containing organic acidic metal salt A[2)] | mass % | 0.60 | 0.65 |
| (B) Phosphorus-containing carboxylic acid compound[3)] | mass % | 0.10 | — |
| (C) Anti-oxidant[4)] | mass % | 1.50 | 1.50 |
| Ashless dispersant[5)] | mass % | 3.38 | 3.38 |
| Metallic detergent[6)] | mass % | 3.70 | 3.70 |
| Other additives[7)] | mass % | 4.00 | 4.00 |
| Element concentration | | | |
| Ca | mass % | 0.200 | 0.200 |
| P | mass % | 0.070 | 0.070 |
| Zn | mass % | 0.070 | 0.070 |
| S | mass % | 0.030 | 0.010 |
| N | mass % | 0.120 | 0.120 |
| Valve train wear test JASOM329-95 | | | |
| Rocker arm scuffing area | % | 0.5 | 2.6 |
| Rocker arm wear | μm | 0.5 | 1.8 |
| Cam nose wear | μm | 1.4 | 13.2 |

[1)]Hydrotreated mineral oil, kinematic viscosity @ 100° C.: 4.7 mm2/s, viscosity index: 120, sulfur content: 10 mass ppm, % CA: 0.6

[2)]Zinc dibutylphosphate represented below, phosphorus content: 12.8 mass %, zinc content: 12.8 mass %, R: butyl

[3)]β-dithiophosphorylated propionic acid represented below, phosphorus content: 9.9 mass %, R: isobutyl

[4)]4,4'-methylene-bis-2,6-di-tert-butylphenol and dialkyldiphenylamine

[5)]Polybutenyl succinicimide, nitrogen content: 2.0 mass %, weight-average molecular weight: 2500

[6)]Ca salicylate, total base number: 170 mgKOH/g, calcium content: 6 mass %

[7)]Additives containing viscosity index improver (PMA, OCP), anti-foaming agent

2)

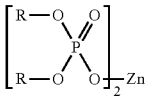

3)

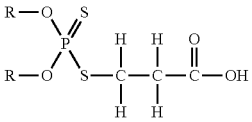

As described above, the lubricating oil composition of the present invention is significantly excellent in extreme pressure properties, anti-wear properties, and base number retention properties as well as oxidation stability and anti-corrosion properties. Therefore, the composition is applicable as various lubricating oils required to possess such properties. Furthermore, the composition can be further improved in high temperature detergency and oxidation stability by properly selecting the type or content of a metallic detergent or an ashless dispersant. The composition can be used as a low sulfur and phosphorus lubricating oil composition whose sulfur and phosphorus contents are 0.3 percent by mass or less and 0.08 percent by mass or less, respectively. Alternatively, since the sulfated ash content of the composition can be adjusted to a desired level, such as from 0.01 to 1.2 percent by mass, preferably 0.8 percent by mass or less, and more preferably 0.6 percent by mass or less, the composition is useful as a lubricating oil composition for an internal combustion engine, which composition does not degrade the purifying performances of exhaust-gas purifying devices (for example, exhausts-gas catalysts such as three-way catalysts, oxidation catalysts, and NOx adsorber and/or DPF (diesel particulate filter)).

Furthermore, the present invention is also useful as a low sulfur and phosphorus engine system for lubricating internal combustion engines using a low sulfur fuel (gas oil, gasoline or gas), using the above-described low sulfur and phosphorus lubricating oil composition and can prolong the maintenance intervals of power-generating engine system such as cogeneration system and automobile engine systems, using a fuel such as a low sulfur gas oil or kerosene whose sulfur content is 50 ppm by mass or less, a sulfur-free gasoline, or an LP gas or natural gas, due to the lubricating oil with improved long-drain properties.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A lubricating oil composition comprising a lubricating base oil consisting essentially of at least one of a mineral base oil and a synthetic base oil other than a diester and a polyol ester, (A) at least one type selected from the group consisting of metal salts of sulfur-free phosphorus-containing acidic organic compounds represented by formula (1) below in an amount of 0.02 to 0.2 percent by mass in terms of phosphorus on the basis of the total amount of the composition:

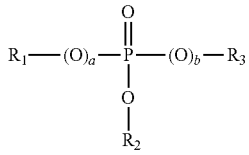

(1)

wherein a and b are each independently 0 or 1, provided that a and b are not both 1, is a hydrocarbon having 1 to 30 carbon atoms, $R_1$and $R_3$are each independently hydrogen or an alkyl or alkenyl group having 1 to 12 carbon atoms, provided that at least one of $R_1$, $R_2$, and $R_3$is hydrogen, (B) at least one type selected from the group consisting of phosphorus-containing carboxylic acid compounds and metal salts thereof, (C) at least one type selected from the group consisting of antioxidants, (D) an ashless dispersant comprising a boric acid-modified alkenylsuccinimide, and (E) at least one metallic detergent selected from the group consisting of an alkali metal or alkaline earth metal salicylate having a metal ratio of 1.5 or less in an amount of 0.05 percent by mass or more in terms of metal; wherein a sulfated ash content of the composition is 0.8 percent by mass or less.

2. The lubricating oil composition according to claim 1 wherein the phosphorus-containing carboxylic acid compounds are those represented by formula (2) below:

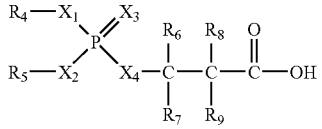

(2)

wherein $X_1$, $X_2$, $X_3$, and $X_4$are each independently oxygen or sulfur, $R_4$and $R_5$are each independently a hydrocarbon group having 1 to 30 carbon atoms, and $R_6$, $R_7$, $R_8$, and $R_9$ are each independently hydrogen or a hydrocarbon group having 1 to 4 carbon atoms.

3. The lubricating oil composition according to claim 2 wherein in the compound represented by formula (2), two of $X_1$, $X_2$, $X_3$, and $X_4$are sulfur and the others are oxygen.

4. The lubricating oil composition according to claim 1 wherein the metal is at least one type selected from the group consisting of alkali metals, alkaline earth metals, zinc, copper, aluminum, and molybdenum.

5. The lubricating oil composition according to claim 1 wherein the (C) anti-oxidant is a phenolic and/or aminic anti-oxidant.

6. The lubricating oil composition according to claim 1 wherein the content of Component (B) is from 0.001 to 0.05 percent by mass in terms of sulfur on the basis of the total mass of the composition.

7. The lubricating oil composition according to claim 1 wherein the total content of Components (A) and (B) is 0.08 percent by mass or less in terms of phosphorus.

8. The lubricating oil composition according to claim 1 wherein the % C A and sulfur content of the lubricating base oil are 3 or less and 0.05 percent by mass or less.

9. The lubricating oil composition according to claim 1 wherein the composition is used for an internal combustion engine.

10. The lubricating oil composition according to claim 9 wherein the internal combustion engine is equipped with a catalyst for exhaust-gas purification selected from an oxidation catalyst, a NOx adsorber, and a three-way catalyst and/or DPF.

11. A low sulfur and low phosphorus engine system wherein an internal combustion engine using a fuel whose sulfur content is 50 ppm by mass or less is lubricated using a lubricating oil composition comprising a lubricating base oil consisting essentially of at least one of a mineral base oil and a synthetic base oil other than a diester and a polyol ester, (A) at least one type selected from the group consisting of metal salts of sulfur-free phosphorus-containing acidic organic compounds represented by formula (1) below in an amount of 0.02 to 0.2 percent by mass in terms of phosphorus on the basis of the total amount of the composition:

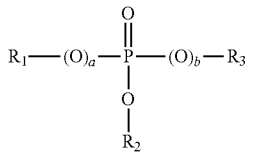

(1)

wherein a and b are each independently 0 or 1, a hydrocarbon having 1 to 30 carbon atoms, $R_1$ and $R_3$are each independently hydrogen or an alkyl or alkenyl group having 1 to 12 carbon atoms, provided that at least one of $R_1$, $R_2$and $R_3$is hydrogen, (B) at least one type selected from the group consisting of phosphorus-containing carboxylic acid compounds and metal salts thereof, (C) at least one type selected from the group consisting of anti-oxidants, (D) an ashless dispersant comprising a boric acid-modified alkenylsuccinimide, and (E) at least one metallic detergent selected from the group consisting of an alkali metal or alkaline earth metal salicylate having a metal ratio of 1.5 or less in an amount of 0.05 percent by mass or more in terms of metal; wherein a sulfated ash content of the composition is 0.8 percent by mass or less, and containing sulfur in an amount of 0.3 percent by less and phosphorus in an amount of 0.08 percent by mass or less on the basis of the total amount of the composition.

12. The lubricating oil composition according to claim 1, wherein the sulfated ash content of the composition is 0.6 percent by mass or less.

13. The lubricating oil composition according to claim 1, wherein the salicylate detergent has a metal ratio of 5 or more.

14. The lubricating oil composition according to claim 11, wherein the salicylate detergent has a metal ratio of 5 or more.

* * * * *